US005196865A

United States Patent [19]

Morelle et al.

[11] Patent Number: 5,196,865

[45] Date of Patent: Mar. 23, 1993

[54] TEMPERATURE SENSING OF HEATER POINTS IN THERMAL PRINT HEADS BY RESISTIVE LAYER BENEATH THE HEATING POINTS

[75] Inventors: Claude Morelle, Chatenay Malabry; Bernard Mouchet, Paris, both of France

[73] Assignee: Axiohm, Montrouge, France

[21] Appl. No.: 703,261

[22] Filed: May 20, 1991

[30] Foreign Application Priority Data

May 23, 1990 [FR] France ..... 90 06444

[51] Int. Cl.[5] ..... B41J 2/325

[52] U.S. Cl. ..... 346/76 PH

[58] Field of Search ..... 346/76 PH

[56] References Cited

U.S. PATENT DOCUMENTS

| | | | |
|---|---|---|---|
| 4,449,033 | 5/1984 | McClure et al. | 346/76 PH |
| 4,837,586 | 6/1989 | Brownstein | 346/76 PH |
| 5,036,337 | 7/1991 | Rezanka | 346/1.1 |

FOREIGN PATENT DOCUMENTS

| | | | |
|---|---|---|---|
| 0291156 | 12/1986 | Japan | 400/120 |

OTHER PUBLICATIONS

Patent Abstracts of Japan vol.5, No. 14 (M-52) (686) Jan. 28, 1981 and JP-A-55144178 (Tokyo Shibaura Denki K.K.) Nov. 10, 1980.

Patent Abstracts of Japan vol. 6, No. 23 (M-111) (901) Feb. 10, 1982 and JP A-56142081 (Ricoh K.K.) Nov. 6, 1981.

Patent Abstracts of Japan vol. 11, No. 111 (M-578) (2558) Apr. 8, 1987 and JP A-61255872 (Matsushita Electric Ind. Co. Ltd.) Nov. 11, 1986.

Patent Abstracts of Japan vol. 12, No. 52 (M-668) (2899) Feb. 17, 1988 and A-62199471 (Mitsubishi Electric Corp.) Sep. 3, 1987.

*Primary Examiner*—Benjamin R. Fuller
*Assistant Examiner*—Huan Tran
*Attorney, Agent, or Firm*—Griffin Butler Whisenhunt & Kurtossy

[57] ABSTRACT

Beneath its line of heater points, the print head includes a film of thermoresistive material which is used for sensing temperature in the proximity of the heater points, thereby making it possible to obtain a signal which can be used quickly in regulating the quantity of energy delivered to each heater point, thereby making it possible to operate the points at a higher rate because they are subjected to excitation which is regulated.

7 Claims, 1 Drawing Sheet

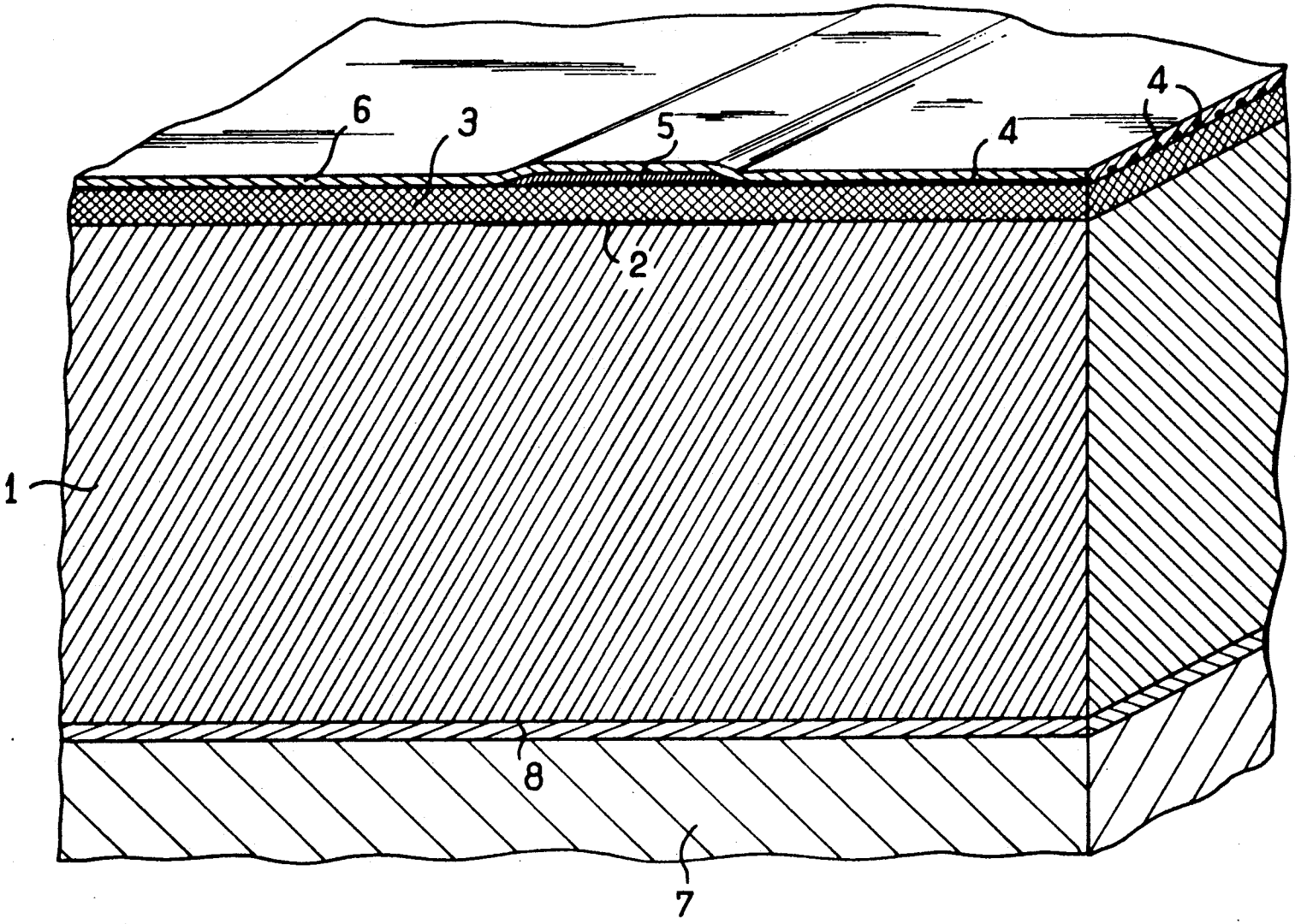
1
2
3
4
4
5
6
7
8

TEMPERATURE SENSING OF HEATER POINTS IN THERMAL PRINT HEADS BY RESISTIVE LAYER BENEATH THE HEATING POINTS

BACKGROUND OF THE INVENTION

A print head for a thermal printer comprises a support plate supporting a line of heater points, each of which is constituted by an electrical resistance element capable of heating up under the Joule effect, and inserted in a current power conductor including an electronic switch.

The principle on which such an apparatus operates is simple. It consists firstly in causing a strip of temperature-sensitive paper to travel beneath the line of points and in contact therewith, and secondly in powering successive series of heater points so as to raise their temperatures for a short period of time to higher than their reaction temperature of the paper. Each point heated in this way thus leaves a mark on the paper, and the size of the mark depends on various factors such as the width of the heater point (taken transversely to the travel direction of the paper), the travel speed of the paper, the time the specified temperature is maintained at the point, . . . . One the next sequence, other points are heated up, while the preceding points cool down, and the mark resulting from a succession of such sequences forms the desired print.

In practice, numerous problems need to be solved, given the ever-increasing performance required of such printers.

One of these problems lies in regulating the temperature of each heater point. A certain amount of energy needs to be applied to a point in order to raise it to the temperature required for marking the paper. This energy for reaching the desired temperature is conveyed to the point in the form of a (rectangular) electrical pulse whose area depends both on the thermal inertia of the resistive material and on the starting temperature of the point to be heated. Unfortunately, the starting temperature is a function of factors that are independent of one another, and in particular it depends both on ambient temperature and on the time between two successive heating pulses. For any one point, these two factors are entirely random and variable, one depending on the printing that is being done while the other depends on the climatic and atmospheric conditions of the place where the printer is being used. It is therefore necessary to know the starting temperature of a point in order to be able to adjust the amount of energy that is to be delivered to the point so as to heat it sufficiently to obtain the desired result. Insufficient heating gives rise to no mark at all or to a mark having too little contrast. Excessive heating overdoes the marking and destroys fineness in the printing.

Present printers are fitted with a temperature sensor which is provided in the form of a thermistor type component. This component is disposed on the substrate at a considerable distance from the line of points, and as a result the response time of the component is of an order of magnitude (about 10 seconds) that is unacceptable, given the rate at which the temperature state of a line of points can change due to ever-increasing excitation rates. By way of example, the period of the pulses may be about 1 millisecond and this is to be compared with the 10 or 20 seconds response time of the temperature sensor, thus leading to regulation with a delay of 10,000 to 20,000 lines of print points.

An object of the present invention is to remedy this drawback by providing a thermal print head that includes means for providing a measurement of the temperature of the heater points with an extremely short response time, thus making it possible to provide fine regulation of the quantity of energy delivered to each heater point, thereby guaranteeing printing of constant quality both along the line and over time.

Under present conditions it is pointless and economically prohibitive to seek to sense the temperature directly of each point and at each heating pulse (thereby determining the energy to be delivered). It is nevertheless highly advantageous to be able to have the mean temperature of the line of points very quickly or at least the mean temperatures of various lengths of the line of hot points. First regulation should enable this mean temperature to be maintained at a given fraction of the reaction temperature of the paper. This improves print regularity. In addition, by discovering this mean temperature quickly, it is possible to associate its value with other operating parameters relating to the line of points, e.g. the excitation frequency of each of the points, thereby making it possible to draw conclusions suitable for "personalizing" the energy delivered to any given point, thus improving regulation.

SUMMARY OF THE INVENTION

As a result in order to improve print quality by effective regulation of the temperature of the heater points, the present invention provides a thermal print head comprising on an insulating substrate: a layer of glass having a top surface supporting the line of heater points and their power conductors, which conductors extend perpendicularly to the line of points; and a protective layer covering the top surface of the glass provided with the line of points and with the conductors;

which print head includes, beneath the line of heater points, a film of thermoresistive material which is electrically insulated from the line of heater points.

Heat is dissipated from the heater points both towards the paper and towards the substrate. Since the rear face of the substrate is generally fitted with a heat-dissipating radiator or "heat-sink", heat flows preferentially perpendicularly through the substrate. The optimum position for the thermoresistive material is thus straight below said line of points since it is in this zone that said material is subjected to the most intense flow of heat.

A first function of the film is thus to act as a temperature sensor by measuring resistance. The closer the sensor to the line of points, the quicker its reaction time.

Thus, in a preferred embodiment, the film is placed between the substrate and the layer of glass, or else is placed in the middle of the layer of the glass, which layer then needs to be applied to the substrate in two stages with the thermoresistive material of the film being put into place between the two applications. Placing the sensor perpendicular to the line of points but on the other face of the substrate does not, however, go beyond the scope of the invention. Although such a solution performs less well, it nevertheless performs much better than presently-known devices.

Advantageously, the heat-dissipating radiator is applied via a layer of thermally-conductive material to the face of the substrate opposite to its face provided with the heater points. This disposition provides two advantages. Firstly it establishes a heat bridge that spreads out through the substrate the heat received by the heated points of the line. A degree of heat spreading thus occurs at the bridge, thereby enhancing heat exchange between hot points and cold points. This makes for a more uniform temperature in the line of points. Secondly, contact between the substrate and the radiator is made much more intimate, thereby improving the flow of heat from the line of points to the radiator. In the past, this flow of heat was somewhat non-uniform because a poor contact point could occur between the substrate and the radiator straight below a heated point. Under such conditions, the heat is constrained to flow along a longer path to go round the discontinuity.

This disposition of the invention is particularly advantageous when the heater points of the line are not physically separate from one another, as is now generally the case, since it enables cooling conditions to be equalized for all of the heater points of a line.

BRIEF DESCRIPTION OF THE DRAWING

An embodiment of the invention is described by way of example with reference to the sole FIGURE of the accompanying drawing which shows a print head of the invention in fragmentary section passing through the line of heater points.

DETAILED DESCRIPTION

In conventional manner, the thermal print head shown comprises an insulating ceramic substrate 1 (based on alumina) which constitutes the structure of the head and which is in the form of a plate that is about half a millimeter thick while its width is about 10 centimeters.

According to the invention, a film 2 of thermoresistive material such as platinum for example is deposited on the substrate. Deposition techniques are known. One such technique comprises silk screening an organometallic ink which is baked at about 1,000°C. The shape of the film 2 is determined experimentally as a function of the required resistance values. It may be constituted either by a simple rectangle extending over the entire width of the substrate, or else it may be constituted by a somewhat longer conducting frieze pattern. The film may be electrically continuous or it may comprise a plurality of lengths.

The top surface of the substrate including this film of thermoresistive material is then covered in conventional manner in a layer of glass 3 (glass coating), likewise by silk screening and baking, leaving appropriate gaps in suitable locations for providing access to the film 2 for making electrical connections thereto.

Conducting layers of gold are then formed on the layer of glass 3, and the gold is then subdivided into conductors 4 by photoetching (or by any other conventional method).

Resistive material 5 constituting the line of heater points is then deposited transversely to the conductors and over them.

In a manner which is likewise known, this material is deposited in a line and it is either physically divided into distinct points, each of which is inserted in a power supply circuit (conductor 4), or else it is continuous and it is heated in lengths as a function of the connections established electronically between the conductors 4 and a power supply.

Finally, a layer of protective material 6 overlies at least the zone including the line of heater points for electrically insulating the circuits thus formed from the outside and for constituting a layer that protects the line of heater points from being abrased by the paper running past it.

The film 2 is made of a material whose resistivity varies in a manner which is directly proportional to its temperature, so measuring the resistance of the film provides an indication of its temperature and consequently provides an indication of the temperature of the line of heater points. Given the very small distance between the film and the line of heater points, any changes in the temperature of the heater points have an immediate influence on the temperature of the sensor film.

The resistance of the film therefore varies very quickly, and a signal relating thereto can be used as a control parameter in a system for servocontrolling the energy to be applied to the heater points, e.g. to maintain substantially constant the maximum temperature to which each heater point is raised.

Naturally, the sensor film could be split up into a plurality of lengths in order to provide a larger number of measurements and in order to enable a plurality of groups of heater points to be regulated separately since non-uniform use may be made of the heater points, depending on the printing to be performed.

The temperature measurements are necessarily mean values relating to pluralities of points that are, in fact, at different temperatures. The measured data may be processed in association with parameters relating to the frequency with which power is applied to the points, which parameters may be provided by the print controller unit. This makes it possible to provide finer regulation.

Another disposition consists in seeking to reduce the temperature gradient that may exist between the points so as to reduce the range of temperatures over which regulation is to be performed. To make this possible, it is necessary to enhance firstly the rate at which hot points cool down and secondly the rate of heat exchange along the line of points. To do this, the invention proposes disposing a layer 8 of a highly thermally conductive material (e.g. silver) between the substrate 2 and a conventional radiator 7 present on the other face of the ceramic plate 1, thereby firstly improving thermal contact between the radiator 7 and the plate 1 and thus enhancing heat transfer through the thickness of the head towards the heat-dissipating radiator, and secondly forming a spreader to spread heat beneath the line of heater points and thus enhance heat exchange between hot points and cold points.

A print head of the invention fitted in this way with its thermoresistive film (made of any appropriate material) possesses an additional advantage. The film can be made use of as a resistance for heating up the line of points. It must be observed that such thermal printers are subjected to extremely severe operating conditions since they may be installed in apparatus that is located outside and subjected to very severe climate.

The film 2 may therefore be connected to an electrical power supply during determined periods of time (prior to printing and during printing) with power being delivered in the form of pulses or pulse trains that are interspersed with periods for monitoring and measurement purposes while the film is connected to a different power supply. The switching of the film between the measurement power supply and the heating power supply may be under the control of a control device of the type including a multiplexer function, should that be necessary.

We claim:

1. A thermal print head comprising:

an insulating substrate;

a layer of glass on a first face of the substrate and said layer of glass having a top surface supporting a line of heater points and power conductors connected to said heater points, which conductors extend perpendicularly to the line heater points;

an electrically-insulating and erosion-resisting protective layer covering a top surface of the layer of glass, the line of heater points and the conductors;

a layer of thermal conducting material disposed on a second face of the substrate opposite to the first face and a heat dissipating radiator on said layer of thermal conducting material; and wherein the head further includes a sensor film of thermo-resistive material beneath the line of heater points, which film is electrically insulated from the line of heater points.

2. A print head according to claim 1, wherein the sensor film is placed between the substrate and the layer of glass.

3. A print head according to claim 1, wherein the sensor film is inserted inside the layer of glass.

4. A print head according to claim 1, wherein the sensor film is placed on the second face of the substrate.

5. A print head according to claim 1, having means connected thereto for sequentially applying electrical power to the sensor film, which power is dissipated thereby in a form of heat.

6. A print head according to claim 1 wherein the sensor film senses temperatures of the line of heater points.

7. A print head according to claim 1 wherein a resistivity of the sensor film varies in direct proportion to temperatures thereof. r

* * * * *